United States Patent [19]

McAdams

[11] 4,073,494

[45] Feb. 14, 1978

[54] PLAYING CARD HOLDER

[76] Inventor: Patricia Louise McAdams, 1865-B S. O'Neal Ave., Charleston, S.C. 29404

[21] Appl. No.: 716,191

[22] Filed: Aug. 20, 1976

[51] Int. Cl.[2] ..... A63F 1/10

[52] U.S. Cl. ..... 273/150; 40/124.2

[58] Field of Search ..... 273/150, 130 D; 40/124.2, 124.4

[56] References Cited

U.S. PATENT DOCUMENTS

| | | | |
|---|---|---|---|
| 2,520,490 | 8/1950 | Boward | 273/150 |
| 4,006,905 | 2/1977 | Marbury | 273/150 |

FOREIGN PATENT DOCUMENTS

| | | | |
|---|---|---|---|
| 305,893 | 5/1918 | Germany | 273/150 |
| 111,797 | 12/1917 | United Kingdom | 273/150 |

*Primary Examiner*—Anton O. Oechsle

*Attorney, Agent, or Firm*—Larry Harold Kline

[57] ABSTRACT

A device is disclosed which holds playing cards, comprising a structure, a plurality of slots in the top of the structure, and a shield connected to the structure which makes the playing cards unreadable to other persons playing in the card game.

17 Claims, 2 Drawing Figures

PLAYING CARD HOLDER

This invention relates to a holder for playing cards, and more particularly to a holder which hides the playing cards from the view of other players during the game and during break periods in the playing time of the game.

Persons with arthritis, or some other ailment, may need help in holding playing cards in order to participate in card games.

During the playing of many card games, the player may have occasion to leave the playing area. Some of the many reasons for leaving the playing area may be as follows: answering the telephone; obtaining refreshments; closing or opening windows; controlling heating or air conditioning units; answering the needs of a child; answering a basic call of nature; and many other potential reasons.

The present invention provides a holder for the cards in the playing hand of the player. Using the present invention, the playing cards cannot be seen by other players during the game, or during the time the player has left the playing area.

An object of the present invention is to provide a holder for playing cards.

Another object of the present invention is to provide a holder for playing cards which will provide protection from other players seeing the playing cards.

Another object of this invention is to provide a holder for playing cards to be used by persons who need physical help in holding the playing cards.

Still another object of this invention is to provide a holder for playing cards that can be turned in a manner so that the playing cards cannot be seen even when the player has temporarily left the playing area.

Another object of this invention is to provide a holder for playing cards that is easily stored.

Still another object of this invention is to provide a holder for playing cards which supports and holds the faces of playing cards vertically during the playing time and downward during break periods in the playing time.

Still another object of this invention is to provide a shield attached to the card holder to prevent the cards from being seen by other players.

Another object of this invention is to provide a holder for playing cards which gives easy vision of all of the cards to the player.

Still another object of this invention is to provide a holder for playing cards in which the cards can be easily seen by potential spectators or television cameras which are observing the card game, and still provides privacy for the player from the other players.

These and other objects and features of the invention will be apparent from the following description and appended claims.

Briefly, the invention is a device for holding playing cards for a card player. The device comprises a structure operative to rest on a surface, a plurality of slots in the top of the structure, and a shield connected to the structure. The plurality of slots holds the playing cards vertically with respect to the surface. The plurality of slots holds the playing cards so that they are readable to the card player facing the structure. The shield prevents other persons playing with the card player from seeing and reading the playing cards. The structure has a front comprising a plurality of flat front sections. When the structure is turned ninety degrees, the structure may rest on the plurality of flat front sections laid upon the surface. The length of the shield may be equal to the length of the outer section of the structure. The outer section of the structure may be curved. The shield may be curved. A plurality of pegs may be attached to and extend from the shield. A plurality of holes may be in the structure whereby the plurality of pegs fits into the plurality of holes to attach the shield to the structure. Each of the plurality of slots may be positioned so that a perpendicular line could be drawn to the front from one end of each slot of the plurality of slots without passing through any other slot. The front may further comprise a curved front section. When the structure is turned ninety degrees so that the plurality of flat front sections rests on the surface, each slot is angled at less than ninety degrees with respect to the surface. The front of the playing cards held in the plurality of slots would then angularly face the surface. The left end is closer to the front of the structure than the right end of the slots.

The invention will be more fully understood from the following detailed description and appended claims when taken with the drawings in which:

Figure 1:
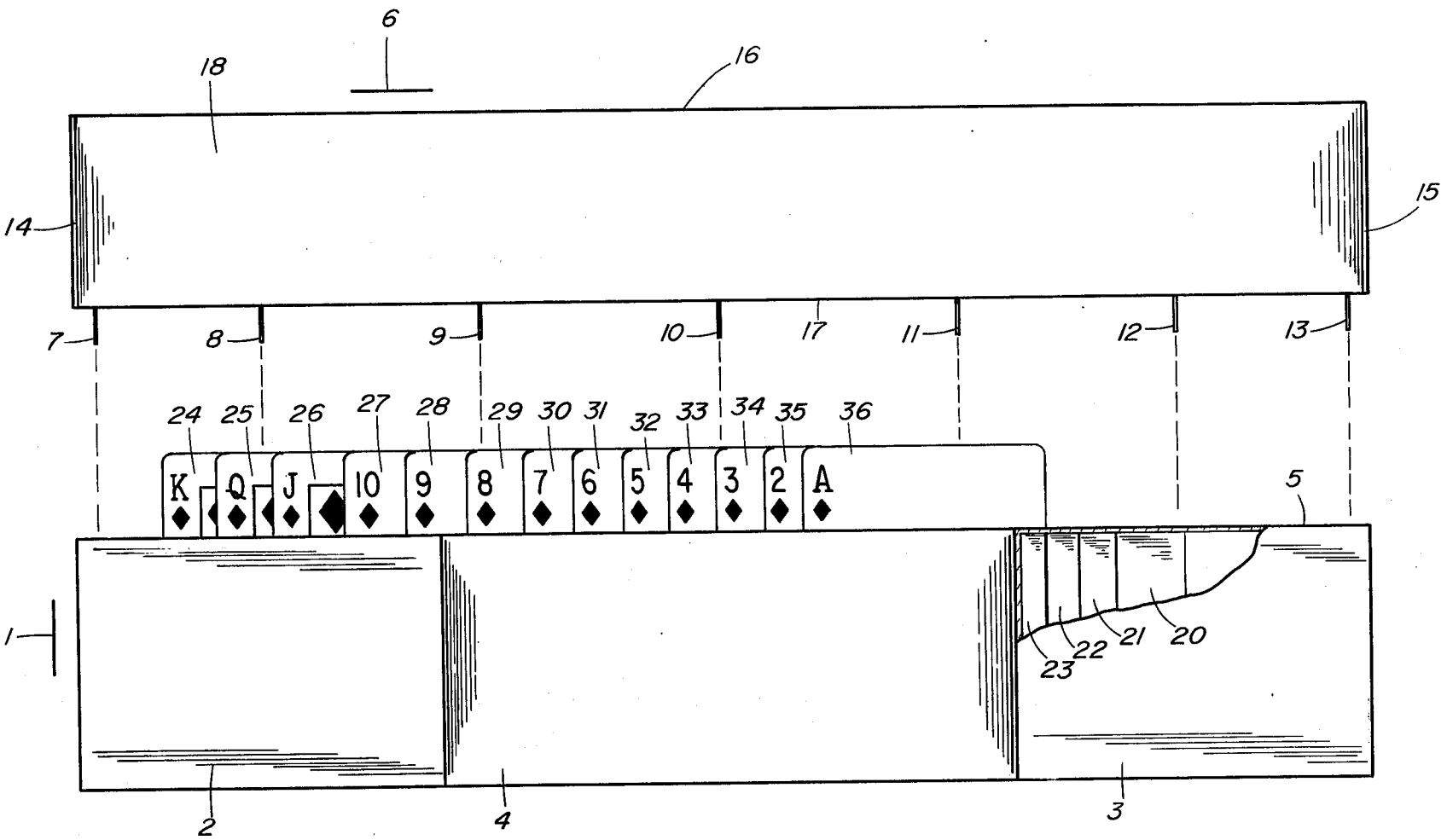
FIG. 1 is a front view of the card-holding device with the shield exploded from the device and a partial cut-away view of the right flat front of the device showing interior support.

Referring now to the drawings, FIG. 1 shows a front view of card-holding device 1 with the shield 6 exploded from the card-holding device 1 and a partial cut-away view of right flat front 3 of the card-holding device 1 showing interior support. Card-holding device 1 comprises left flat front section 2, right flat front section 3 and center curved front section 4. Slotted top 5 contains various slots within which playing cards can be placed.

Shield 6 is connected within slotted top 5. Shield 6 comprises left edge 14, right edge 15, top edge 16, bottom edge 17, inner edge 18, and outer edge 19.

FIG. 1 shows braces 20, 21, 22, and 23 in the cut-away view of right flat front section 2.

Figure 2:
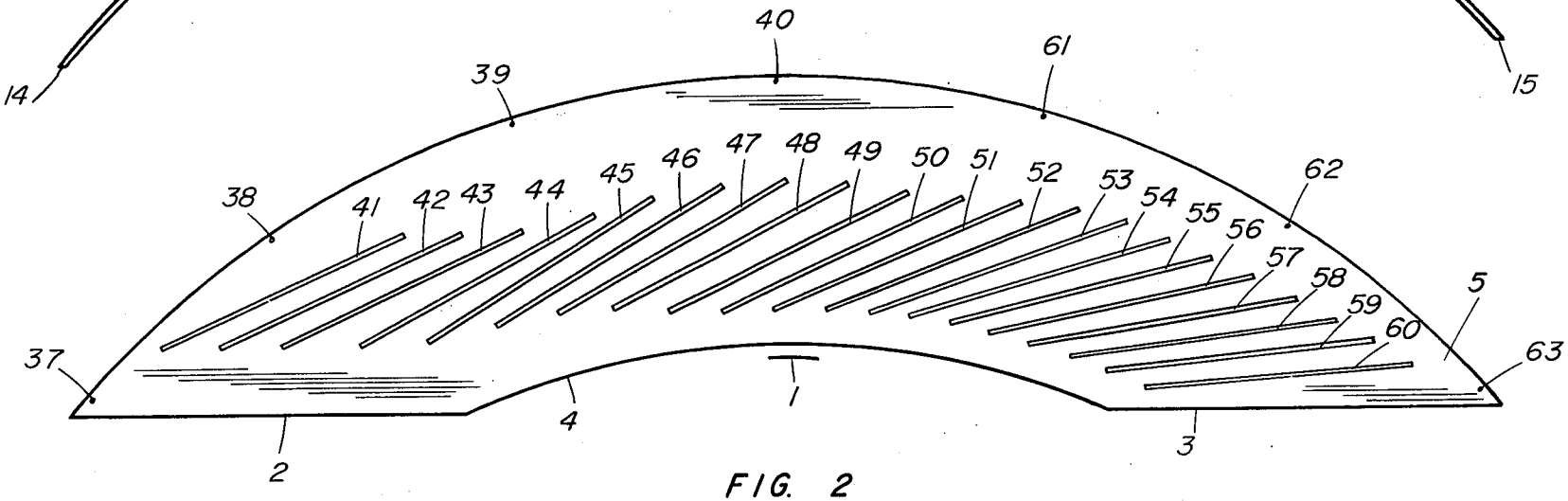
FIG. 2 is a top view of the device shown in FIG. 1 without the shield, which is the same as a front view of the device with flat front sections 2 and 3 turned flat on a surface.

FIG. 2 shows a top view of the card-holding device 1 shown in FIG. 1 without shield 6. A top view of the card-holding device 1 is the same as a front view of card-holding device 1, when the front flat sections 2 and 3 are turned flat on a surface.

FIG. 2 shows slots 41–60 which are inserts within slotted top 5 within which playing cards can be inserted. Slotted top 5 also contains holes 37, 38, 39, 40, 61, 62, and 63.

Figure 3:
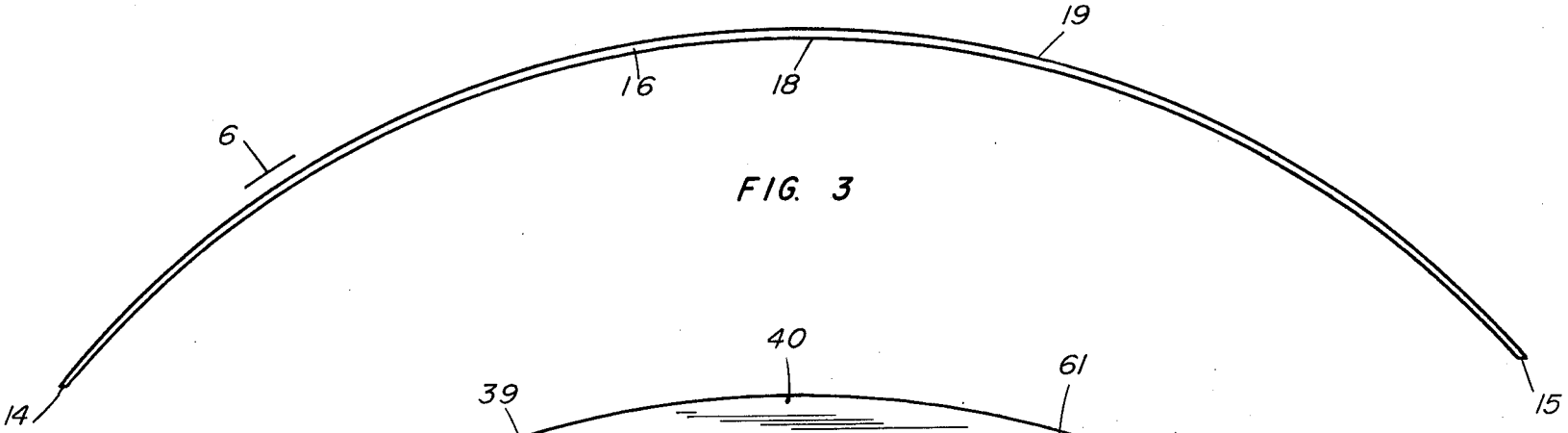
FIG. 3 is a top view of the shield shown in FIG. 1.

FIG. 3 shows a top view of the shield 6. Players sitting left of the player using card-holding device 1 would not be able to see the cards held in slots 41–60 around the left edge 14 of shield 6, or below the top edge 16 of shield 6. Players sitting right of the player using card-holding device 1 would not be able to see the cards held in slots 41–60 around the right edge 15 of shield 6, or below the top edge 16 of shield 6. The bottom edge 17 of shield 6 rests on slotted top 5. Pegs 7, 8, 9, 10, 11, 12, and 13 emanate from bottom edge 17 of shield 6.

When shield 6 is fitted onto slotted top 5 of card-holding device 1, peg 7 fits into hole 37, peg 8 fits into hole 38, peg 9 fits into hole 39, peg 10 fits into hole 40, peg 11 fits into hole 61, peg 12 fits into hole 62, and peg 13 fits into hole 63.

In FIG. 1, thirteen cards are shown inserted into slotted top 5. The King 24 is shown in slot 41, Queen 25 is shown in slot 42, Jack 26 is shown in slot 43, the Ten 27 is shown in slot 44, the Nine 28 is shown in slot 45, the Eight 29 is shown in slot 46, the Seven 30 is shown in slot 47, the Six 31 is shown in slot 48, the Five 32 is shown in slot 49, the Four 33 is shown in slot 50, the Three 34 is shown in slot 51, the Two 35 is shown in slot 52, and the Ace 36 is shown in slot 53. Slots 54, 55, 56, 57, 58, 59, and 60, in FIG. 1, do not contain a card.

While FIG. 1 shows thirteen cards in place, the particular card-holding device 1 shown can contain up to twenty cards. This invention may be used for a varying amount of slots in the card-holding device 1. The card-holding device 1 with twenty slots can also be used for a game in which fewer cards are required than the amount of slots that are available.

In FIG. 1, the partial cut-away view of right front flat section 3 of card-holding device 1 shows interior support from braces 20, 21, 22, and 23. Brace 20 stands between slots 59 and 60. Brace 21 stands between slots 58 and 59. Brace 22 stands between slots 57 and 58. Brace 23 stands between slots 56 and 57. Other similar braces stand between the various slots in card-holding device 1 for purposes of support. The braces support the cards in an up-right, easily seen position and prevent the cards from slipping inside the card-holding device 1. A card in slot 60 would be supported by right flat front section 3 and brace 20. A card in slot 59 would be supported by braces 20 and 21. A card in slot 58 would be supported by braces 21 and 22. A card in slot 57 would be supported by braces 22 and 23. Other cards in any of the other slots would be supported by braces (not shown) on both sides of the slot.

The card-holding device 1 can be made of any material desired, and can be of solid construction or can be basically open inside.

The slots in slotted top 5 must be placed so that no player on either side of the player using the card-holding device 1 can see the cards placed in the slots. Slots may be placed anywhere on slotted top 5 as long as the cards placed within them are not visible to the other players. The slots are progressively spaced so that the cards may be easily visible to the player. The slots could be completely formed slots with a molded piece completely surrounding the card. The slots may be simply openings within the slotted top 5 and the opening within the card-holding device 1 between two braces such as braces 20, 21, 22, and 23 shown in FIG. 1. The slots may also be any other type of slot which is desired and which holds the cards properly. The slots may be color-coded, if desired.

The shield 6 may be permanently attached to the card-holding device 1, or may be removable, as shown in the drawings. The removable shield 6 may be placed directly behind card-holding device 1 for packing or storing purposes. When the card-holding device 1 is turned ninety degrees, front sections 2 and 3 lay flat on the surface where the bottom of the card-holding device 1 previously lay. With the shield 6 in place, the shield 6 becomes somewhat of an umbrella over the cards, blocking the view of the cards. The cards which were held up-right are then turned ninety degrees also. The faces of the cards face downward and are then not even visible to someone looking from the front. This invention enables the game to be stopped for some interruption and be easily continued by simply returning card-holding device 1 to the original position. The center curved front section 4 may be curved or flat, or of any other desired shape. The card-holding device 1 is shown with a center curved front section 4 simply for design purposes, and to save cost in material. The entire front could be flat, if desired, or any plurality of flat front sections with any other indented sections for design or other purposes.

Since most playing cards have the indication of the playing card in the upper left portion of the playing card, the slots are angled so that the left end of the slot is closer to the front of the card-holding device 1 than the right end of the slot. This enables the upper left portion of the card to be seen and for the card player to easily identify the card. If a deck of playing cards has the indication of the card in the upper right portion of the card rather than the upper left portion, the slots would be angled differently and the right end of each slot would be closer to the front of the card-holding device 1. As shown in the drawings, a perpendicular line may be drawn from the front of the card-holding device 1 to the left end of each slot without passing through any other slot. As can be seen in FIG. 2, each of the slots in non-parallel with respect to most of the remaining slots.

While the invention has been described with reference to specific embodiments, the description is illustrative and is not to be construed as limiting the scope of the invention. Various modifications and changes may occur to those skilled in the art without departing from the spirit and scope of the invention as defined by the appended claims.

I claim:

1. A device for holding playing cards for a card player comprising:

(a) a structure operative to rest on a surface;

(b) a plurality of non-parallel slots in the top of said structure operative to hold said playing cards vertically with respect to said surface and said nonparallel slots being angled sufficiently and so disposed relative to each other that an upper corner of said playing cards indicating the identity of said playing cards is visible and readable only to said card player facing said structure, each of said non-parallel slots completely surrounding the lower portion of each of said playing cards when each of said playing cards is inserted in each of said non-parallel slots; and (c) a shield connected to said structure operative to make said playing cards unreadable to other persons playing with said card player.

2. A device according to claim 1 wherein said structure has a front comprising a plurality of flat front sections whereby when said structure is turned ninety degrees, said plurality of flat front sections rests on said surface.

3. A device according to claim 1 wherein the length of said shield is equal to the length of said structure where said shield is connected to said structure.

4. A device according to claim 1 wherein said structure is curved where said shield is connected to said structure.

5. A device according to claim 4 wherein said shield is curved.

6. A device according to claim 5 wherein the length of said shield is equal to the length of said structure where said shield is connected to said structure.

7. A device according to claim 6 wherein said structure has a front comprising a plurality of flat front sections whereby when said structure is turned ninety degrees, said plurality of flat front sections rests on said surface.

8. A device according to claim 1 further comprising a plurality of pegs attached to and extending from said shield for use in attaching said shield to said structure.

9. A device according to claim 8 further comprising a plurality of holes in said structure whereby said plurality of pegs fits into said plurality of holes to attach said shield to said structure.

10. A device according to claim 2 wherein each of said plurality of slots is positioned so that a line may be drawn perpendicular to said front from said front to one end of each slot of said plurality of slots without passing through any other slot of said plurality of slots.

11. A device according to claim 10 wherein said front may further comprise a curved front section.

12. A device according to claim 10 wherein said structure is turned ninety degrees so that said plurality of flat front sections rests on said surface, each slot of said plurality of slots is angled at less than ninety degrees with respect to said surface, and the front of said playing cards held in said plurality of slots angularly faces said surface.

13. A device according to claim 10 wherein said one end of each slot of said plurality of slots is the left end.

14. A device according to claim 13 wherein said left end of each slot of said plurality of slots is closer to said front of said structure than the right end of each slot of said plurality of slots.

15. A device according to claim 7 wherein when said structure is turned ninety degrees so that said plurality of flat front sections rests on said surface, each slot of said plurality of slots is angled at less than ninety degrees with respect to said surface, and the front of said playing cards held in said plurality of slots angularly faces said surface.

16. A device according to claim 14 wherein when said structure is turned ninety degrees so that plurality of flat front sections rests on said surface, each slot of said plurality of slots is angled at less than ninety degrees with respect to said surface, and the front of said playing cards held in said plurality of slots angularly faces said surface.

17. A device according to claim 16 wherein said one end of each slot of said plurality of slots is the left end.

* * * * *